United States Patent [19]

Schreiber

[11] Patent Number: 4,828,251

[45] Date of Patent: May 9, 1989

[54] BALANCE AND COORDINATION EXERCISE DEVICE

[76] Inventor: Bernard Schreiber, 7 montee du Chauden, 72300 Albertville, France

[21] Appl. No.: 149,531

[22] Filed: Jan. 28, 1988

[51] Int. Cl.[4] ..... A63B 25/08

[52] U.S. Cl. ..... 272/114; 272/93

[58] Field of Search ..... 272/114, 70.3, 146, 272/73, 52, 93; 280/289 R, 1.18 Z

[56] References Cited

U.S. PATENT DOCUMENTS

| | | | |
|---|---|---|---|
| 2,723,855 | 11/1955 | McKee | 272/114 |
| 2,960,345 | 11/1960 | Chontos | 280/1.182 |
| 3,432,162 | 3/1969 | Flemming | 272/114 |
| 3,751,032 | 8/1973 | Boyle | 272/114 |
| 4,018,440 | 4/1977 | Deutsch | 272/70.3 |
| 4,681,332 | 7/1987 | Malone | 272/70.3 |

OTHER PUBLICATIONS

Pogy-Pony, Wash. Post, Sep. 10, 1971, p. D16.

*Primary Examiner*—Richard J. Apley
*Assistant Examiner*—J. Welsh
*Attorney, Agent, or Firm*—Bright & Lorig

[57] ABSTRACT

An exercise device for developing or improving balance and for simulating mountain bicycle riding and trail motorcycle riding includes a frame that has two upright support members joined to and spaced apart by a rigid transverse member with each of the upright support members connected at their lower end to compressible, biased, slidable members having flat-surfaced, ground-engaging members at the bottom of each upright support member.

14 Claims, 4 Drawing Sheets

BALANCE AND COORDINATION EXERCISE DEVICE

BACKGROUND OF THE INVENTION

This invention relates to exercise and training devices that develop and improve balance and coordination.

SUMMARY OF THE INVENTION

These devices include a frame comprising a first upright, rigid support member, a second upright, rigid support member, and a rigid transverse member joining the first upright support member to the second upright support member. The rigid transverse member separates the first and second upright support members from one another a distance substantially equivalent to the distance between the front and rear wheels of a motorcycle or bicycle. In preferred embodiments, the transverse member slants downwardly and rearwardly from the point of connection to the first upright support member to the point of connection with the second upright support member. In preferred embodiments, the first upright support member slants upwardly and slightly rearwardly toward the second upright support member; the second upright support member slants upwardly and slightly forwardly toward the first upright support member.

At its upper end, the first upright support member is connected to handlebar means. Preferably, the width of these handlebar means, and their height above the ground-engaging surface of the device, are substantially similar to the corresponding dimensions of a trail motorcycle or a bicycle.

The handlebar means preferably comprise a first bar member adapted for attachment to the first upright support member. This first member is joined, at substantially right angles, to a second bar member that tapers laterally upwardly and outwardly from the first bar member. The second bar member preferably includes detachable hand grips at each end to facilitate gripping the handlebars firmly. In preferred embodiments, the first bar member fits slidably inside of, and attaches to the first upright support member at a plurality of points along its length, thus permitting adjustment of the height of the handlebars above the ground-engaging surface of the device.

Attached at the upper end of the second upright support member are seating means such as a conventional bicycle or motorcycle seat. The seating means is preferably attached to a member that fits slidably inside the second upright support member, thus permitting adjustment of the height of the seating means above the ground-engaging surface of the device.

Connected to the first upright support member is first leg means slidable with respect to the first upright support member and linked to the first upright support member through means that bias the slidable leg means downwardly. In preferred embodiments, the slidable leg means compress the biasing means when a downward force is exerted upon the device, as when a rider mounted on the device exerts his weight downwardly. In preferred embodiments, the first upright support means has a longitudinal passage that receives the biasing means, and the slidable leg means fits into this same passage below the biasing means. In some of these preferred embodiments, the slidable leg means includes longitudinally-extending slot means for permitting upward and downward sliding movement of the slot means over pin means that pass through the slot means and through the walls of the leg means to attach the leg means slidably to the first support means.

In other preferred embodiments, the slidable leg means includes shoulder means at or near the upper end of the leg means for engaging the biasing means inside the passage. This alternative embodiment of the slidable leg means fits into the same passage. Cap means that engage, preferably threadably, the first upright support means near the open end of the passage, hold the leg means in the passage. This cap means has an opening of substantially the same diameter as the leg means so that the cap can slide over the leg means after the leg means has been inserted into the passage, and then threadably engage the bottom of the first upright support member to keep the shoulder means inside the passage means.

Connected to the second upright support member are second leg means slidable with respect to the second upright support member and linked to the second upright support member through means that bias the second slidable leg means downwardly. In preferred embodiments, the second slidable leg means compress their biasing means when a downward force is exerted upon the device, as when a rider mounted on the device exerts his weight downwardly. In preferred embodiments, the second slidable leg means and the biasing means for the second slidable leg means are substantially the same as the first slidable leg means and first biasing means.

In preferred embodiments, the biasing means inside the first upright support member and the biasing means inside the second upright support member are substantially the same in compression and expansion strength so that when a rider mounted on the device exerts downward force on the device, the first slidable leg means and the second slidable leg means travel upwardly against the biasing means a substantially equal distance.

In preferred embodiments, the biasing means is spring means. These spring means are, in preferred embodiments, confined at their upper end inside the first upright support member by a biasing means-receiving surface of sufficient size and shape to support the biasing means and to receive the compressive force of the biasing means without moving. The receiving surface may include shoulder means at or near the upper end of the leg means. The biasing means is preferably a hollow coil spring that is sufficiently long, and has sufficient compression and expansion strength to withstand compression forces exerted by a rider having some predetermined maximum body weight, for example, 200 pounds or 300 pounds.

In preferred embodiments, the length of the frame of the device, the height of the handlebars above the ground-engaging surface of the device, and the height of the seat above the ground-engaging surface of the device, are substantially similar to the corresponding dimensions in a trail motorcycle or bicycle. When so configured, the device permits a rider mounted thereon to simulate the problems of balance and coordination encountered in riding trail motorcycles and bicycles over terrain that tends to unbalance the bicycle or motorcycle, and requires the rider to shift his weight to keep the vehicle upright and moving forward.

Attached at or near the bottom of each upright support means are ground-engaging means. In some preferred embodiments, these ground-engaging means are flat-bottomed pads connected to the bottom of the upright support means, preferably through ball-and-socket joints that permit the frame to move laterally when the flat-bottomed pads are in engagement with the ground. Alternatively, the ground-engaging member may be one or two wheels joined to the bottom end of each upright support member by appropriate connector mean. In still other embodiments, the ground-engaging means can be spherical or semispherical pad that permits the frame to move laterally when these pads are in engagement with the ground.

Attached to, and extending laterally from the rigid transverse member of the frame are, in preferred embodiments, foot pegs of a size and shape to accommodate the soles of a rider's feet or footwear. These pegs permit a rider to exercise or train in a substantially standing position with his feet on the pegs and his hands gripping the handlebar. Accordingly, the foot pegs are attached to the rigid transverse member near the second, or rear, upright support member, and are preferably adjustable in position to accommodate riders of different heights and weights. These pegs are, in some embodiments, parts of a single unit that includes means for attaching the unit to the transverse member.

BRIEF DESCRIPTION OF THE DRAWINGS

These devices can better be understood by reference to the drawings, in which.

DESCRIPTION OF THE PREFERRED EMBODIMENT

Figure 1:
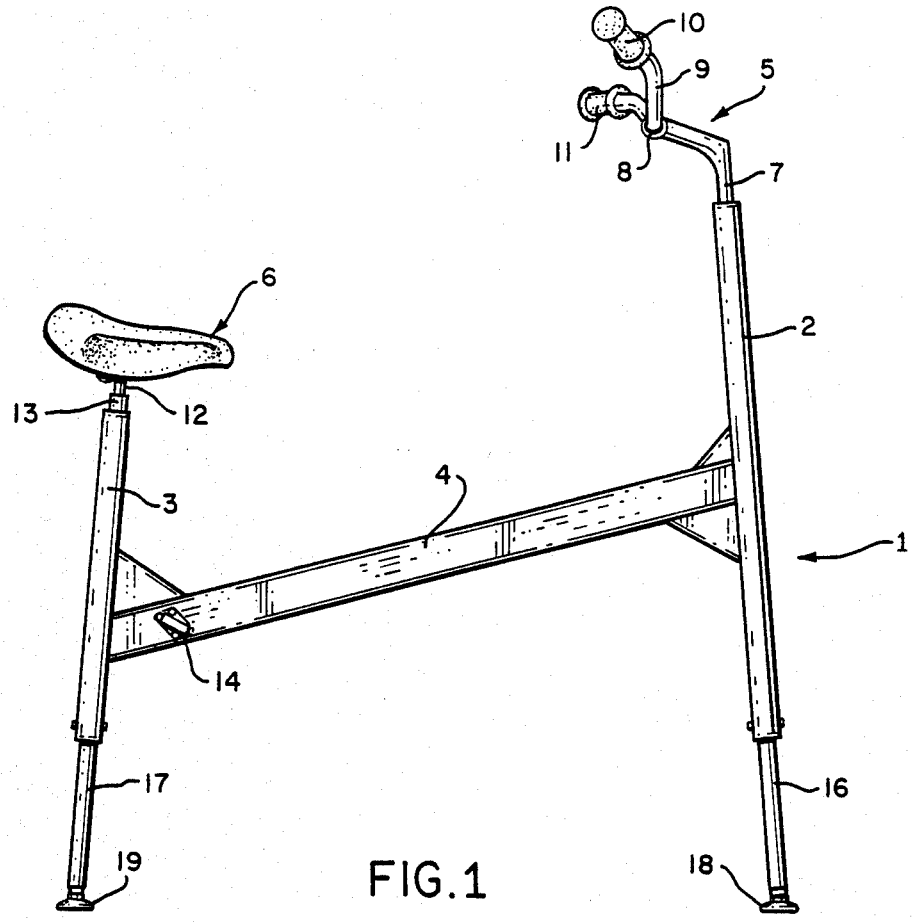
FIG. 1 shows a side elevation view of a preferred embodiment of the device.

FIGS. 1–4 show a preferred embodiment of the exercise and training device 1 of this invention. Device 1 comprises a frame including first upright support member 2 and second upright support member 3. Upright support members 2 and 3 are joined to rigid transverse member 4, which separates members 2 and 3 a distance about equal to the distance between the axles of a trail motorcycle.

Joined to the top of upright support member 2 is handlebar assembly 5. Joined to the top of upright support member 3 is seat 6. Both handlebar assembly 5 and seat 6 are adjustable in height. Handlebar assembly 5 includes arm 7, which fits within an opening at the top of upright support member 2. Arm 7 is joined through connector 8 at substantially right angles to handlebar 9. Handlebar 9 has suitable slip-resistant grips 10 and 11 at opposite ends, and tapers upwardly and outwardly from connector 8 toward grips 10 and 11. Seat 6 is fixedly mounted on shaft 12, which fits inside a hollow opening at the top of upright support member 3. Threaded nut 13 permits the height of seat 6 to be adjusted to accommodate riders of different heights.

Figure 2:
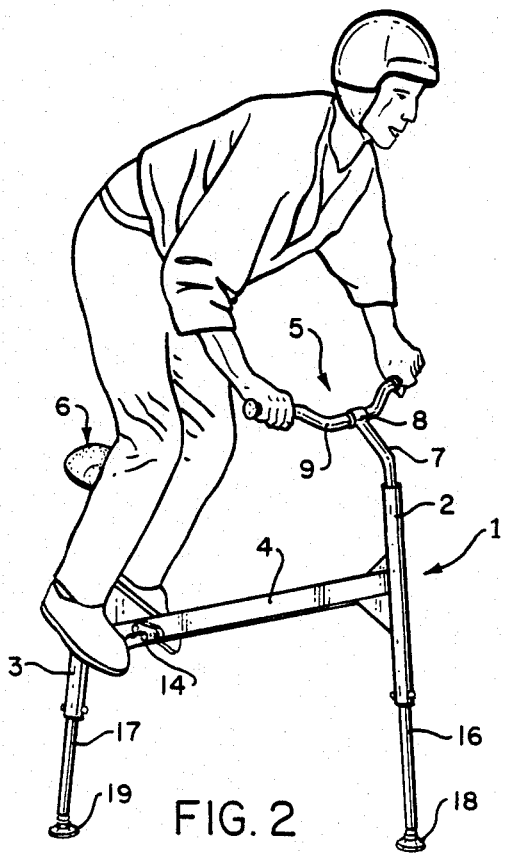
FIG. 2 shows a right-side perspective view of the device depicted in FIG. 1 seen from the front with a rider astride the device.
Figure 3:
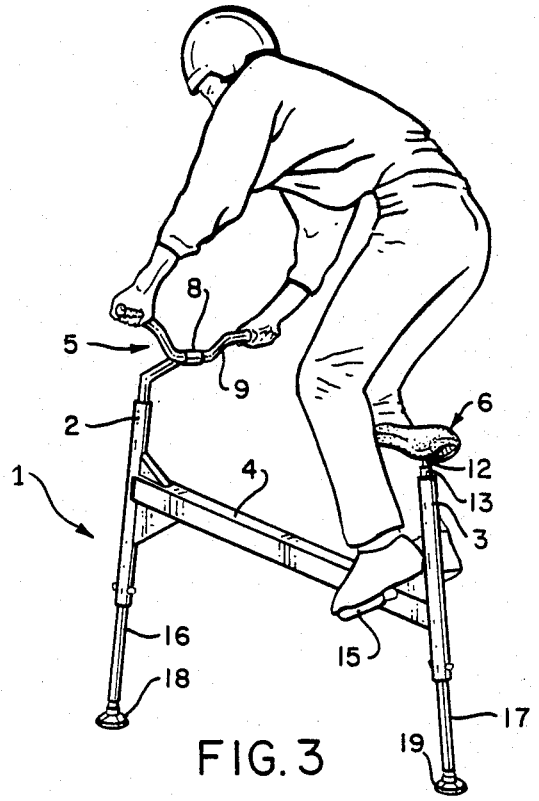
FIG. 3 shows a perspective view of the device depicted in FIG. 1 seen from the rear with a rider astride the device.

Attached to, and projecting laterally from transverse support member 4 are foot pegs 14 and 15. As FIGS. 2 and 3 show, a rider mounted on device 1 places his feet on pegs 14 and 15, and grips the handlebar assembly 5 with his hands. Foot pegs 14 and 15 are attached to transverse member 4 in front of, but closer to second upright support member 3 than to first upright support member 2. The position of the foot pegs can be adjusted to accommodate riders of different height.

Connected to upright support member 2 at the bottom is slidable leg member 16. A similar slidable leg member 17 is similarly connected to upright support member 3. Connected to the bottom of slidable leg member 16 is ground-engaging, flat-bottomed pad 18. A similar flat-bottomed, ground-engaging pad 19 is connected to the bottom of slidable leg member 17.

Figure 4:
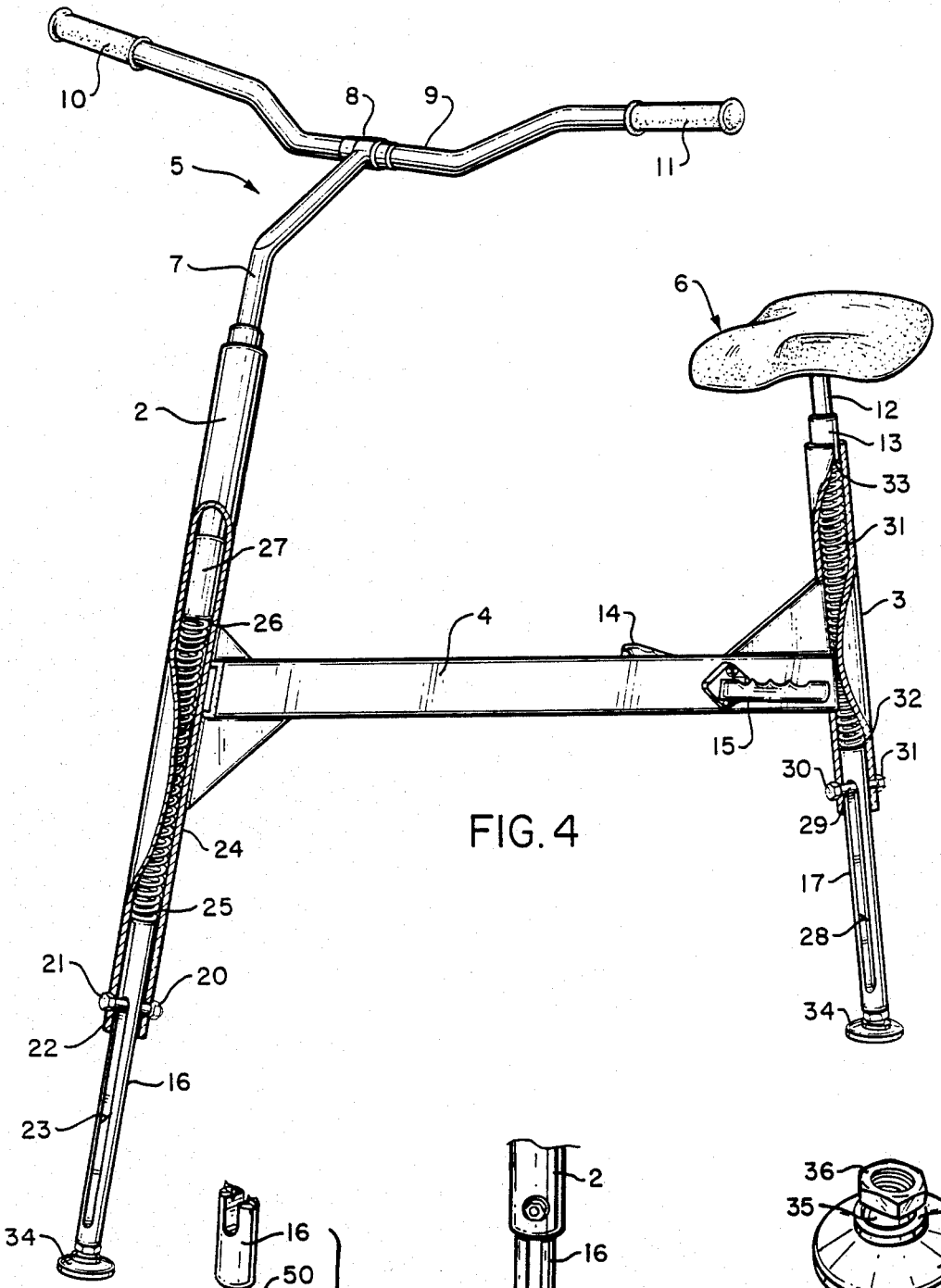
FIG. 4 shows an enlarged perspective view of the device depicted in FIG. 1 with a portion of the first and second upright support members broken away to show the internal biasing of the slidable legs.
Figure 6:
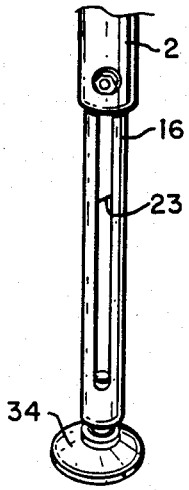
FIG. 6 shows an exploded detail view of the slidable leg member and the attached flat-bottom pads attached to each of the first and second upright support members shown in FIGS. 1–4.
Figure 8:
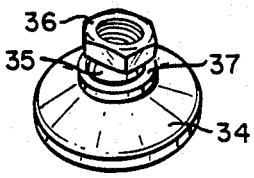
FIG. 8 shows an exploded view of the flat-bottomed pads attached to the bottom of the slidable legs on the device depicted in FIGS. 1–4.

FIGS. 4, 6 and 8 show in detail the construction of, and operation of these slidable leg means. Slidable leg means 16 is attached to upright support member 2 by means of bolt 22 that passes through longitudinally extending slot 23 in slidable leg member 16 and through the walls of support member 2. Cap nuts 20 and 21 threadably engage the ends of bolt 22 that project through the walls of member 2, and prevent bolt 22 from sliding out of slot 23 or out of the walls of upright support member 2.

Slidable leg member 16 is free to slide upwardly and downwardly within upright support member 2. As leg member 16 moves upwardly, slot 23 moves upwardly with respect to bolt 22, and against the downward biasing force exerted by coil spring 24. Spring 24 lies inside upright support member 22 and is compressed between the upper end 25 of slidable leg 16 and the bottom end 26 of stop member 27. Stop member 27 is affixed inside hollow, upright support member 2 with sufficient strength to avoid moving when spring 24 exerts maximum force against end 26.

Similarly, slidable leg member 17 includes longitudinally-extending slot 28 that serves the same function as slot 23 in slidable leg member 16. Bolt 29 passes through the walls of upright support member 3 and through slot 28, and prevents slidable leg 17 from escaping its attachment inside hollow upright support member 3. Cap nuts 30 and 31 at opposite ends of bolt 29 prevent bolt 29 from escaping from either side of upright support member 3 or from slot 28. Coil spring 31, placed inside hollow, upright support member 3 is held in place at one end by the upper surface 32 of slidable leg member 17 and, at its upper end, by the bottom surface of stop member 33. Stop member 33 is affixed inside member 3 with sufficient strength to avoid moving when spring 31 exerts maximum upward force on its bottom surface.

Attached at the bottom of upright support members 16 and 17 are conical-shaped detachable foot members 34. Each of these foot members has a flat-bottomed surface that is slightly larger in diameter than the diameter of slidable leg members 16 and 17. Each of foot members 34 has a ball-and-socket assembly linking foot pad 34 to connector 36. Threaded connector 36 links foot member 34 to slidable leg members 16 and 17. The ball-and-socket assembly includes ball member 35 linked to threaded connector nut 36. Ball 35 is seated in socket 37, and is free to rotate within socket 37 so that device 1 can move laterally with foot members 34 attached to the bottom of slidable leg members 16 and 17.

Figure 7:
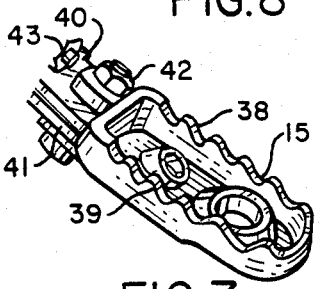
FIG. 7 shows an exploded view of the foot pegs attached to, and projecting from each side of the transverse support member of the device of FIG. 1.

FIG. 7 shows, in exploded view, foot peg 15 having serrated upper edges 38 and 39 and linking members 40 and 41 joined together by bolt-and-nut assembly 42. The entire foot peg assembly is connected to transverse member 4 through bolt-and-nut connector 43.

Figure 5:
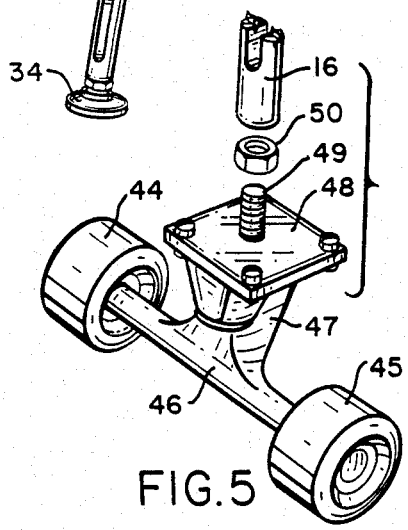
FIG. 5 shows ground-engaging wheels attached to the bottom of the first and second upright support members instead of the flat-bottomed pads shown in FIGS. 1–4, 6 and 8.

FIG. 5 shows an alternative ground-engaging member to pads 34. This ground-engaging member comprises two rotatable wheels 44 and 45 joined together by axle 46. Axle 46 includes, near its center, an upright connector arm 47 joined to platform 48 having a fixed, threadable bolt 49 projecting upwardly from its center. Bolt 49 permits attachment, through cooperation with nut 50, to the bottom end of each of slidable leg members 16 and 17.

In preferred embodiments, the height of the device at its front end measured from the handlebar assembly to the bottom of the ground-engaging pad attached to the slidable leg means is about 40 inches, when the spring is fully extended. The height of the device at its rear end, measured from the plane of the seat to the base of the ground-engaging pad, is about 32 inches, when the coil spring is fully extended. The length of the device, measured from the center of the first upright support member to the center of the second upright support member is about 32 inches. These dimensions approximate the corresponding dimensions of a trail motorcycle or bicycle, and permit a rider mounted on this device to simulate the problems of balance and coordination encountered when riding such a vehicle over rough terrain, or at high speed over any terrain.

By mounting the device and forcing his weight downwardly on the device, a rider can compress each of springs 24 and 31, moving slidable leg members 16 and 17 upwardly, and the frame of the device downwardly. The springs are sufficiently powerful to force the frame upwardly as they expand to their normal length, and the rider can, as the springs expand, cause the entire device to rise from the ground. Such exercise movements simulate the experiences incurred when riding such a vehicle over rough or rugged terrain.

FIGS. 9–13 and 16 show a second preferred embodiment of the exercise and training device 60 of this invention. Device 60 comprises a frame including first upright support member 61 and second upright support member 74. Upright support members 61 and 74 are joined to rigid transverse member 65, which separates members 61 and 74 a distance about equal to the distance between the axles of a trail motorcycle.

Joined to the top of upright support member 61 is handlebar assembly 113. Joined to the top of upright support member 74 is seat 73. Both handlebar assembly 113 and seat 73 are adjustable in height. Handlebar assembly 113 includes arm 68, which fits within an opening at the top of upright support member 61. Arm 68 is joined through connector 88 at substantially right angles to handlebar 69. Handlebar 69 has suitable slip-resistant grips 72 and 71 at opposite ends, and tapers upwardly and outwardly to connector 88 toward grips 71 and 72. Seat 73 is fixedly mounted on shaft 114, which fits inside a hollow opening at the top of upright support member 74. A threaded nut similar to threaded nut 13 (see FIG. 1) permits the height of seat 73 to be adjusted to accommodate riders of different heights.

Figure 9:
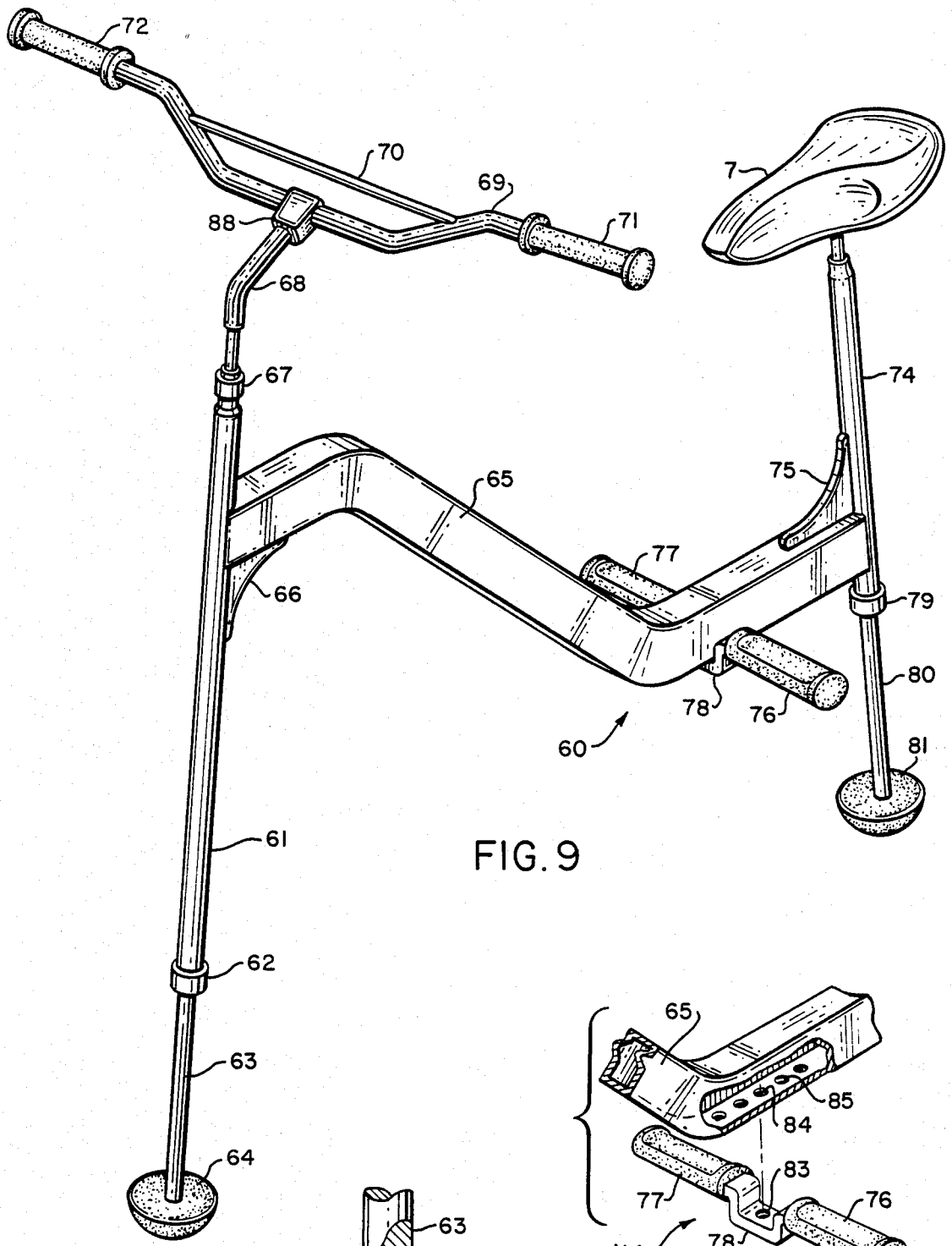
FIG. 9 shows a perspective view of another preferred embodiment of the device.
Figure 11:
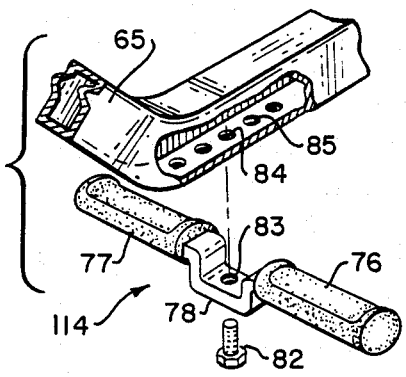
FIG. 11 shows an exploded detail view of the foot peg unit detached from, and attachable to the transverse support member in the device depicted in FIG. 9.
Figure 16:
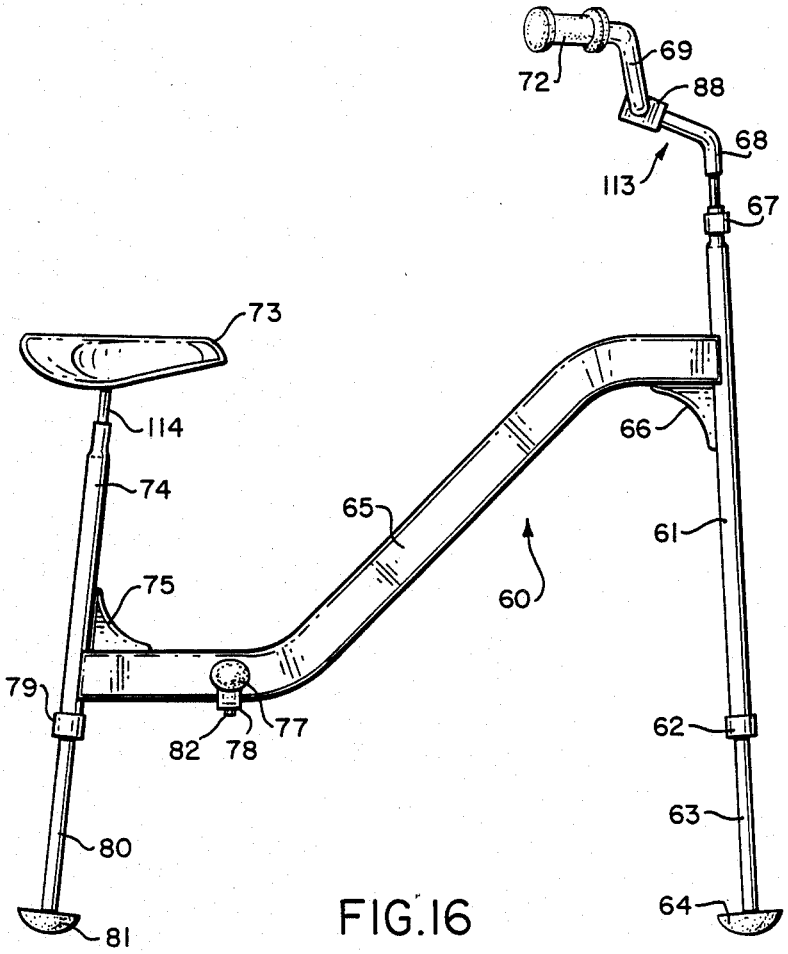
FIG. 16 shows a side elevation view of the embodiment of the device shown in FIG. 9.

Attached to, and projecting laterally from transverse support member 65 are foot pegs 76 and 77. As FIGS. 9, 11 and 16 show, a rider mounted on device 60 places his feet on pegs 76 and 77, and grips handlebar assembly 113 with his hands. Foot pegs 76 and 77 are linked together by connector means 78 to form an integral foot peg unit 114. Unit 114 attached to transverse support member 65 in front of, but closer to second upright support member 74 than to first upright support member 61. The position of the foot peg unit 114 can be adjusted by removing bolt 82 from holes such as 84 and 85 in transverse support member 65, and reattachment of unit 114 to member 65 through a hole that provides suitable placement of unit 114.

Connected to upright support member 61 at the bottom is slidable leg member 63. A similar slide leg member 80 is similarly connected to upright support member 74. Connected to the bottom of leg member 63 is ground-engaging, semispherical-shaped pad 64. A similar pad 81 is connected to the bottom of slidable leg member 80.

Figure 12:
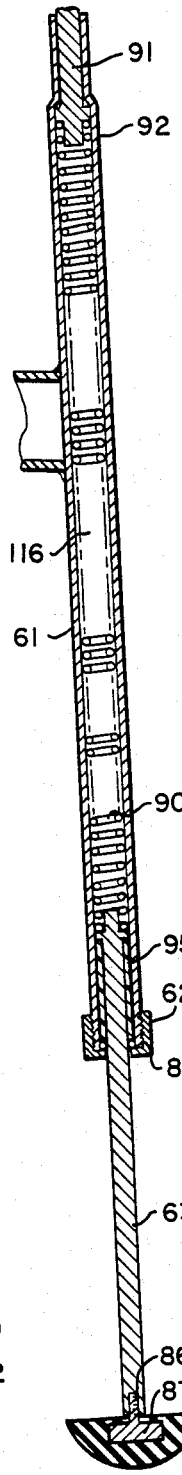
FIG. 12 is an elevational view in cross-section of the first support member in the device depicted in FIG. 9, and shows the cooperation among the biasing means, the slidable leg means that fits inside the first upright support member, and the support member itself, in the embodiment shown in FIG. 9.
Figure 13:
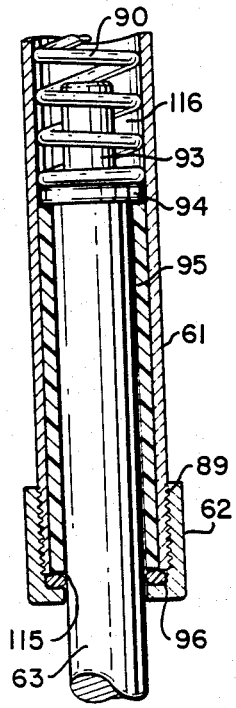
FIG. 13 is an exploded detail view of a portion of the cross-sectional view shown in FIG. 12.

FIGS. 12 and 13 show in detail the construction of, and operation of these slidable leg means. Slidable leg means 63 is attached to upright support member 61 by means of internally-threaded cap 62 that engages threads 89 on the outside wall near opening 115 at the bottom of upright support member 61. Slidable leg means 63 fits inside passage 116 inside upright support member 61. Leg member 63 is smaller in diameter than the inner diameter of passage 116 along its entire length below shoulder means 94. Shoulder means 94 is nearly the same diameter as passage 116, and is greater in diameter than slidable leg means 63. Atop shoulder 94 is pin 93 which is smaller in diameter than shoulder 94 and, preferably, smaller in diameter than leg means 63. Below shoulder 94, and substantially surrounding leg member 63 inside passage 116, is thermoplastic or metal sleeve 95. Sleeve 95 substantially completely fills the gap in the outside wall of slidable leg means 63 and the inner wall surface of passage 116. O-ring 96 sits at the bottom of threadable cup member 62, and facilitates formation of a snug fit between threaded cap 62 and the edge of the surface at opening 115 to passage 116.

Above shoulder 94 is coil spring 90, which fits over pin member 93. Pin member 93 prevents lateral displacement of coil spring 90, and assures that coil spring 90 compresses and expands substantially vertically, and in no other direction. At the other end of interior passage 116, near handlebar assembly 113, is plug member 91, which is affixed to the inside wall of passage 116. Projecting downwardly from insert 91 is pin member 92, which serves substantially the same function at the upper end of coil spring 90 as does pin 93 at the lower end of coil spring 90. Coil spring 90 is in effect captured and maintained inside passage 116 between pins 92 and 93.

Slidable leg member 63 is free to slide upwardly and downwardly within passage 116 and upright support member 61. As leg member 63 moves upwardly, member 63 compresses spring 90, thus moving leg member 63 against the downward biasing force that coil spring 90 exerts on shoulder 94, and consequently on leg member 63. Shoulder 94, sleeve 95, O-ring 96 and cap 62 cooperate to prevent slidable leg member 63 from escaping inside passage 116. Slidable leg member 80 fits within a similar passage inside second upright support member 74, and functions in substantially the same way as slidable leg member 63 does inside first upright support member 61.

Figure 10:
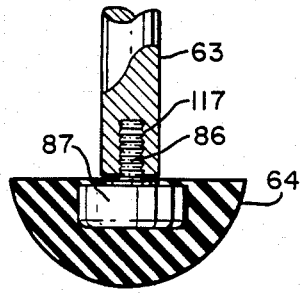
FIG. 10 shows an exploded detail view of the semispherical pads that provide the ground-engaging surface at the bottom of the first and second upright support members of the device shown in FIG. 9.

Attached at the bottom of upright support members 61 and 74 are semispherical-shaped, detachable pads 64 and 81. FIGS. 10 and 12 show the construction of these pads in detail. As FIGS. 10 and 12 show, pad 64 is a semispherical pad with its round side positioned to engage the ground. Embedded within pad 64 is disc member 87 from which bolt 86 projects upwardly. Bolt 86 threads into internally-threaded passage 117 inside slidable leg means 63.

Figure 14:
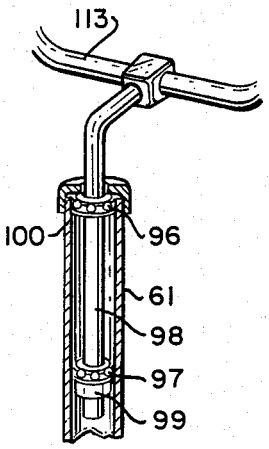
FIG. 14 shows an alternative embodiment to the embodiments shown in FIGS. 1 and 9 for mounting the handlebar means of the device in the first upright support member of the device.

FIG. 14 shows one alternative embodiment for mounting handlebar assembly 113 in first upright support member 61. Shaft 68 passes through ball-bearing-equipped rotatable members 100 and 99, which permit free rotation of handlebar assembly 113 in upright support member 161.

Figure 15:
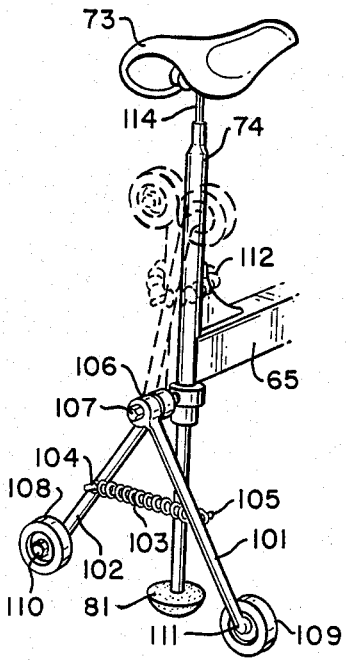
FIG. 15 shows the device depicted in FIG. 9 with removable, storable trainer wheel means attached to the frame of the device.

FIG. 15 shows the addition of training wheels to the device of FIGS. 9 and 16. A training wheel assembly is attached via bolt 107 to threadable cap 79, and includes wheels 108 and 109 mounted on legs 101 and 102. Each of these legs has, at its upper end, an integrally formed ring through which bolt 107 passes. Linking legs 101 and 102 is spring member 103, which attaches to legs 101 and 102 through hooks 105 and 104, respectively. Each of wheels 108 and 109 is free to rotate on shaft 111, and is precluded from escaping shaft 111 by nut 110. The entire training wheel assembly can be swung upwardly for storage, as the dotted lines in FIG. 15 show. Once swung upwardly, these legs can be strapped to an upper portion of upright support member by suitable strap 112.

As with the device depicted in FIGS. 1–8, by mounting device 61 and forcing his weight downwardly on device 60, a rider can compress coil spring 90, and the similar spring inside upright support member 74, moving slidable leg members 63 and 80 upwardly, and the frame of the device downwardly. The springs are sufficiently powerful to force the frame upwardly as they expand to their normal length, and a rider can, as the springs expand, cause the entire device to arise from the ground. Such exercise movements simulate the experiences incurred when riding such a vehicle over rough and rugged terrain.

What is claimed is:

1. A device comprising a first substantially upright support member; a second substantially upright support member; and a substantially rigid transverse member joining said first support member to said second support member; said first upright support member being connected to hand engaging means approximate its upper end, and connected at its lower end to means slidable with respect to said first upright support member, said slidable means being linked to means for biasing said slidable means downwardly, said slidable means having ground-engaging means at its bottom end, said second upright support member being connected to seating means at its upper end, and at its lower end, connected to means slidable with respect to said second upright support member, said second upright support member being linked to means for biasing said second slidable means downwardly, said second slidable means having at its bottom end ground-engaging means.

2. The device of claim 1 wherein said slidable means comprise leg means that fit within, and are slidable with respect to said upright support members, and said biasing means lie inside said upright support means above said slidable leg means and below means for preventing displacement of said biasing means when said biasing means exert maximum upward force thereon.

3. The device of claim 2 wherein each of said slidable leg means comprises shoulder means near the upper end of said leg means that engage said biasing means, and, removably attached to the bottom of said first and second upright support members, means for preventing said shoulder means from escaping said upright support means.

4. The device of claim 1 wherein said hand engaging means further comprising handlebar means connected to said first upright support member at its upper end.

5. A device comprising a first substantially upright support member; a second substantially upright support member; and a substantially rigid transverse member joining said first support member to said second support member; said first upright support member being connected to handlebar means at its upper end, and connected at its lower end to means slidable with respect to said first upright support member, said slidable means being linked to means for biasing said slidable means downwardly, said slidable means having a substantially flat, ground-engaging surface at its bottom end, said second upright support member being connected to seating means at its upper end, and, at its lower end, connected to means slidable with respect to said second upright support member, said second upright support member being linked to means for biasing said second slidable means downwardly, said second slidable means having at its bottom end a substantially flat, ground-engaging surface and, connected to said rigid transverse member along a common axis near, and in front of said second upright support member, two foot pegs, one extending laterally from one side of said rigid transverse member, the other extending laterally from the other side of said rigid transverse member.

6. The device of claim 5 wherein said first upright support member, said second upright support member and said rigid transverse member comprise a frame whose length and height approximates the length and height of a trail motorcycle.

7. The device of claim 5 wherein said handlebars have a length and a height above the ground-engaging surfaces that approximate those of a trail motorcycle.

8. The device of claim 5 wherein said slidable means comprise leg means that fit within, and are slidable with respect to said upright support members, and said biasing means lie inside said upright support means above said slidable leg means and below means for preventing displacement of said biasing means when said biasing means exerts maximum upward force thereon.

9. The device of claim 5 wherein said flat, ground-engaging surfaces comprise flat-bottomed pads connected to each of said slidable means through ball-and-socket joints that are adapted to permit lateral movement of said device.

10. A device comprising a first substantially upright support member; a second substantially upright support member; and a substantially rigid transverse member joining said first support member to said second support member; said first upright support member being connected to handlebar means at its upper end, and connected at its lower end to means slidable with respect to said first upright support member, said slidable means being linked to means for biasing said slidable means downwardly, said slidable means having ground-engaging means at its bottom end, said second upright support member being connected to seating means at its upper end, and, at its lower end, connected to means slidable with respect to said second upright support member, said second upright support member being linked to means for biasing said second slidable means downwardly, said second slidable means having at its bottom end ground-engaging means and, connected to said rigid transverse member along a common axis near, and in front of said second upright support member, two foot pegs, one extending laterally from one side of said rigid transverse member, the other extending laterally from the other side of said rigid transverse member.

11. The device of claim 10 wherein said first upright support member, said second upright support member and said rigid transverse member comprise a frame whose length and height approximates the length and height of a trail motorcycle.

12. The device of claim 10 wherein said handlebars have a length and a height above the ground-engaging means that approximate those of a trail motorcycle.

13. The device of claim 10 wherein said slidable means comprise leg means that fit within, and are slidable with respect to said upright support members, and said biasing means lie inside said upright support means above said slidable leg means and below means for preventing displacement of said biasing means when said biasing means exerts maximum upward force thereon.

14. The device of claim 10 wherein said ground-engaging means comprise rotatable wheel means.

* * * * *